US005966964A

United States Patent [19]

Pattee

[11] Patent Number: 5,966,964

[45] Date of Patent: Oct. 19, 1999

[54] BEVERAGE COOLING APPLIANCE AND METHOD FOR USING SAME

[76] Inventor: Clark C. Pattee, 556 First Ave., Clinton, Iowa 52732

[21] Appl. No.: 09/123,263

[22] Filed: Jul. 28, 1998

[51] Int. Cl.[6] ..... F25D 3/08

[52] U.S. Cl. ..... 62/457.4; 62/459; 62/378; 62/379; 62/383

[58] Field of Search ..... 62/457.4, 459, 62/378, 379, 383

[56] References Cited

U.S. PATENT DOCUMENTS

| | | | |
|---|---|---|---|
| 3,316,734 | 5/1967 | Crane | 62/381 |
| 4,078,397 | 3/1978 | Brande | 62/372 |
| 4,164,851 | 8/1979 | Bryant | 62/381 |
| 4,549,409 | 10/1985 | Smith | 62/381 |
| 4,580,405 | 4/1986 | Cretsmeyer | 62/381 |
| 4,825,665 | 5/1989 | Micallef | 62/372 |
| 5,005,378 | 4/1991 | Ottenheimer | 62/378 |
| 5,282,368 | 2/1994 | Ordoukhanian | 62/372 |
| 5,653,123 | 8/1997 | Handlin | 62/381 |

*Primary Examiner*—Henry Bennett
*Assistant Examiner*—Melvin Jones

[57] ABSTRACT

Disclosed is a beverage cooling appliance (10) comprising a base (18) that holds a battery pack (20), a on/off switch (120), and a pair of upright supports (116 and 118). A framework (30) that is able to swivel upward or downward on a pair of hinge pins (112 and 114), near the top of the upright supports (116 and 118), that holds a pair of drive rollers (26 and 28) with motor/gearbox units (22 and 24) inside the drive rollers (26 and 28) mounted on the framework (30) swing downward to contact a beverage container (12) lying on a bed of ice (14) in a ice tray (16) fixed atop the base (18). When the on/off switch (120) is moved to the on position, electricity from a wall socket or from the battery pack (20) causes the motor/gearbox units (22 and 24) to rotate the drive rollers (26 and 28) imparting rotational movement to the beverage container (12) causing circulation of the liquid in the beverage container (12) and substantially reducing the temperature of the beverage as heat is transferred from the beverage to the bed of ice (14).

2 Claims, 8 Drawing Sheets

BEVERAGE COOLING APPLIANCE AND METHOD FOR USING SAME

BACKGROUND OF THE INVENTION

1. Field of the invention

This invention relates to a appliance for the rapid cooling of beverages in bottles or cans by means of a motor driven appliance that causes a beverage container to rotate while the container is in contact with a bed of ice.

2. Description of the prior art

A number of different devices have been proposed to cool beverage by rotating a beverage container, in or on a bed of ice. The prior art devices however, are large, cumbersome difficult to use and expensive to manufacture.

For example U.S. Pat. No. 5,653,123 issuing Aug. 5, 1997 to Handlin for QUICK COOL DEVICE disclosing a manually powered design that turns a beverage can while it is in a upright position after it is partially buried in pieces of ice. The principle disadvantage being that an ice chest with a large amount of ice has to be used to allow the device to operate, making it inconvenient to cool one or two containers of beverage.

U.S. Pat. No. 5,282,368 issuing Feb. 1, 1994 to Ordoukhanian for BEVERAGE COOLING DEVICE that has to be connected to an ice chest. The principle disadvantage being that if only one or two cans of beverage need to be cooled that a large amount of ice has to be placed in a chest, and it would not be convenient for use on a kitchen counter.

U.S. Pat. No. 5,005,378 issuing Apr. 9, 1991 to Ottenheimer for LIQUID CHILLING APPARATUS and U.S. Pat. No 4,825,665 issuing May 2, 1989 to Micallef for COOLING BEVERAGES are designs that limit the use of the proposed machines to cooling liquids in bottles only. The main disadvantage of these units is that they are to large for convenient use and cannot be used to cool canned beverages.

U.S. Pat. No. 4,580,405 issuing Apr. 8, 1986 to Cretsmeyerfor BEVERAGE COOLING DEVICE AND METHOD FOR USING SAME discloses a device that uses a power pack, turning a suction cup that is attached to a beverage can resting in an ice receptacle. The power pack is designed to slid downward on the side of the ice receptacle, thus putting all of the weight of the power pack on the suction cup. The principle disadvantage being that the suction cup has the tendency to come loose from the beverage container.

U.S. Pat. No. 4,549,409 issuing Oct. 29, 1985 to Smith for APPARATUS FOR COOLING BEVERAGE CONTAINERS AND THE LIKE discloses a beverage cooler that is designed to grip and rotate various size beverage containers by means of cups that hold each end of the beverage container that is placed in an ice receptacle, that is allowed to move up or down by means of springs between the ice try and the base of the apparatus. The primary disadvantages being that the device is large, expensive to manufacture and difficult to use, because it is hard to place the beverage container in the cups with one hand, while holding the ice receptacle down with the other hand.

U.S. Pat. No. 4,164,851 issuing Aug. 21, 1979 to Bryant for BEVERAGE CONTAINER COOLER discloses a device that uses a chest type cooling compartment with long three inch diameter rollers in the bottom of the chest. The rollers are covered with foam and cannot come in contact with the ice cubes, or the ice may tear the foam, so only four to six ice cubes can be used at a time, by placing the cubes between the beverage container and a ice retaining member that forms a V-shaped groove, thus limiting the cooling capacity of the machine and requiring the addition of ice each time the cubes are melted. The device is expensive to manufacture and is to large for convenient use on a kitchen counter.

U.S. Pat. No. 3,316,734 issuing May 2, 1967 to Crane for APPARATUS FOR COOLING CANNED LIQUID discloses a device for cooling canned liquids. The apparatus is expensive, complicated and to large for convenient use.

OBJECTS AND ADVANTAGES OF THE PRESENT INVENTION

Although the prior art cooling devices will cool beverages as described, they would not be as suitable for the purposes of the present invention as heretofore described.

Many canned and bottled beverages should be served at a temperature of 40° F. or below. The problem is that when no refrigerated beverage is available, there is a need to quickly cool liquid refreshments from room temperature down to serving temperature within a few minutes.

The principle object of the present invention is to cool canned or bottled beverages to a proper temperature very quickly.

It is a further object of this invention to be simple, easy and safe to use.

It is a further object of this invention to be small and attractive, so as to be compatible for use on a kitchen counter, or to be easily transported for use at picnics, or other locations where beverages may need to be cooled.

BRIEF DESCRIPTION OF THE DRAWING FIGURES

Various other objects, features and advantages of the present invention will become more fully appreciated as the same becomes better understood when considered in conjunction with the accompanying drawings, in which like reference characters designate the same or similar parts throughout the several views, and wherein.

REFERENCE NUMERALS IN DRAWINGS

Figure 1:
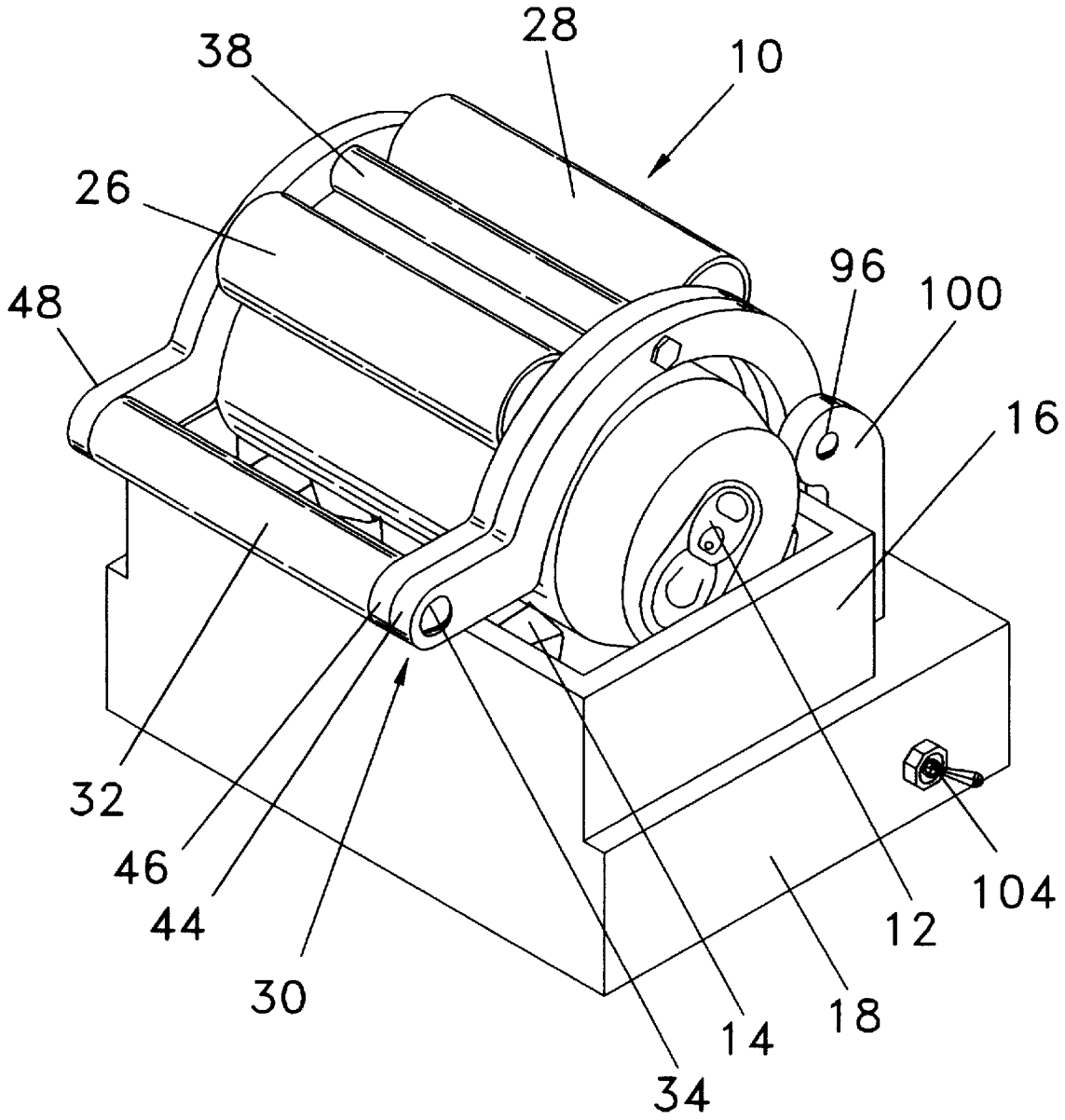
FIG. 1 is a front perspective view of the present invention with the drive rollers resting on a beverage container.
Figure 2:
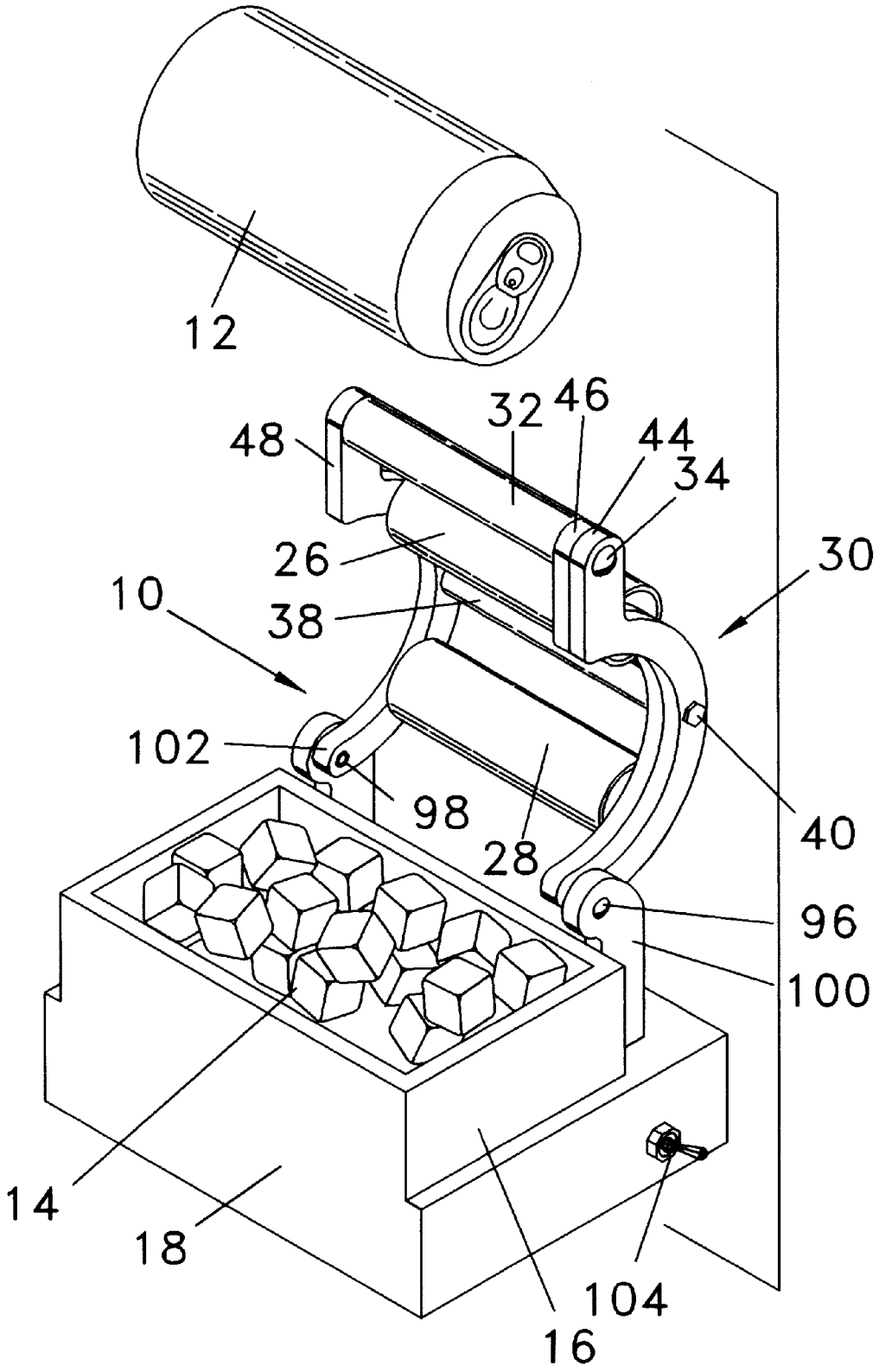
FIG. 2 is a front perspective view of the present invention with the drive rollers and supporting framework in the raised position.
Figure 4:
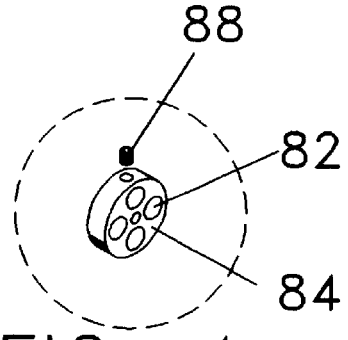
FIG. 4 is a enlarged detail of connecting element 84 shown in a dashed circle and indicated by the number 4, in FIG. 3.
Figure 3:
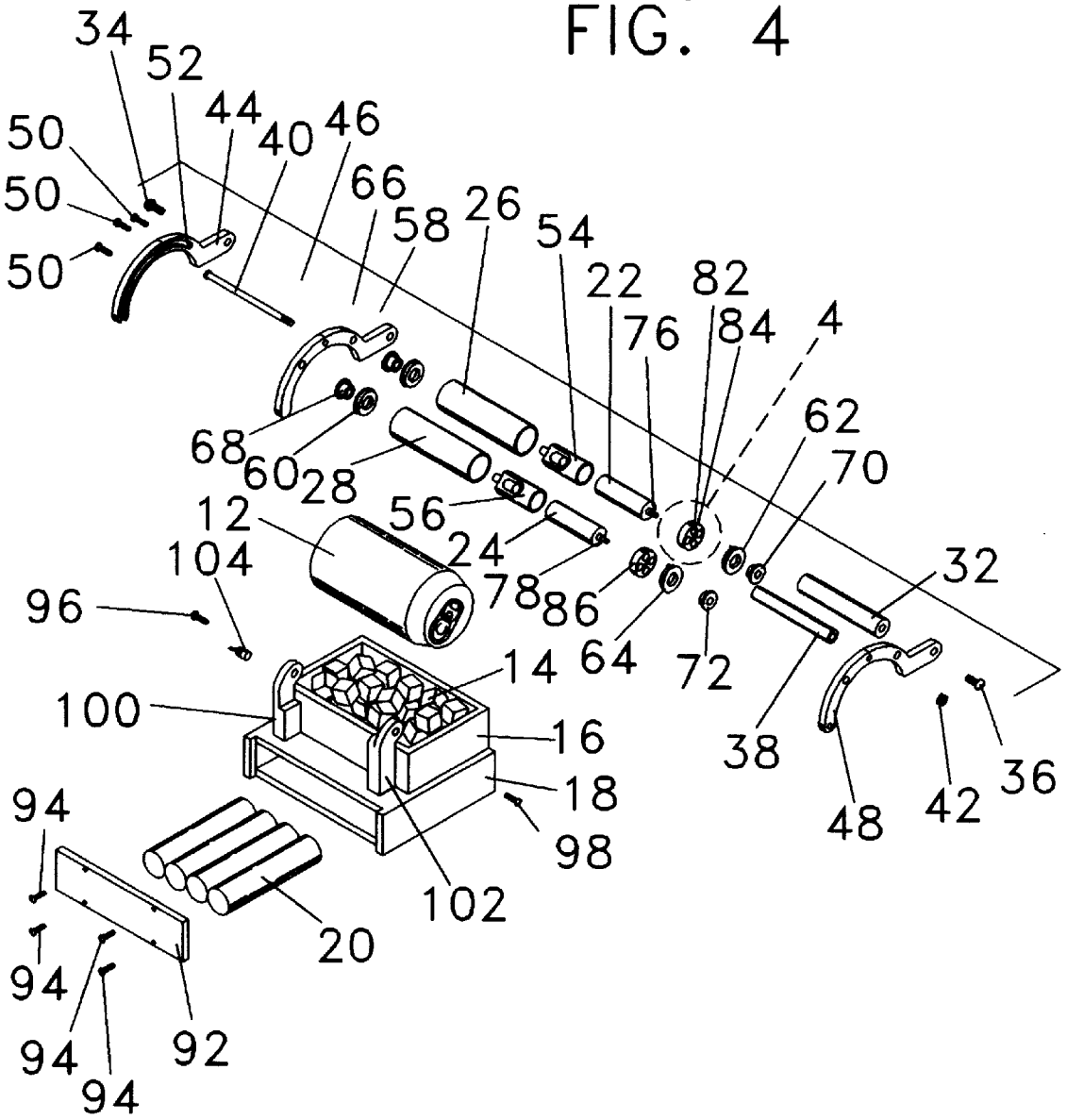
FIG. 3 is a exploded top view of the present invention, showing the internal elements in detail.

FIGS. 1 through 4 reference numbers.

| | | | |
|---|---|---|---|
| 10 | quick cool appliance | 12 | beverage container |
| 14 | bed of ice 16 | 16 | ice tray on 18 |
| 18 | base of 10 | 20 | battery pack in 18 |
| 22 | motor/gearbox unit of 26 | 24 | motor/gearbox unit of 28 |
| 26 | front drive roller | 28 | rear drive roller |
| 30 | framework | 32 | first cross member of 30 |
| 34 | right bolt of 32 | 36 | left bolt of 32 |
| 38 | second cross member of 30 | 40 | bolt of 38 |
| 42 | nut for 40 | 44 | right frame member of 30 |
| 46 | middle frame member of 30 | 48 | left frame member of 30 |
| 50 | screws for 30 | 52 | groove in 44 |
| 54 | motor mount for 22 | 56 | motor mount for 24 |
| 58 | right wheel of 26 | 60 | right wheel of 28 |
| 62 | left wheel of 26 | 64 | left wheel of 28 |
| 66 | bearing of 58 | 68 | bearing of 60 |
| 70 | bearing of 62 | 72 | bearing of 64 |
| 74 | drive shaft of 22 | 76 | drive shaft of 24 |
| 78 | drive pin of 62 | 80 | drive pin of 64 |
| 82 | socket in 86 | 84 | connecting element of 74 |
| 86 | connecting element of 76 | 88 | set screw of 84 |
| 90 | set screw of 86 | 92 | cover of 20 |
| 94 | screws for 9 | 96 | right hinge pin of 30 |
| 98 | left hinge pin of 30 | 100 | right upright support |
| 102 | left upright support | 104 | on/off switch |

Figure 5:
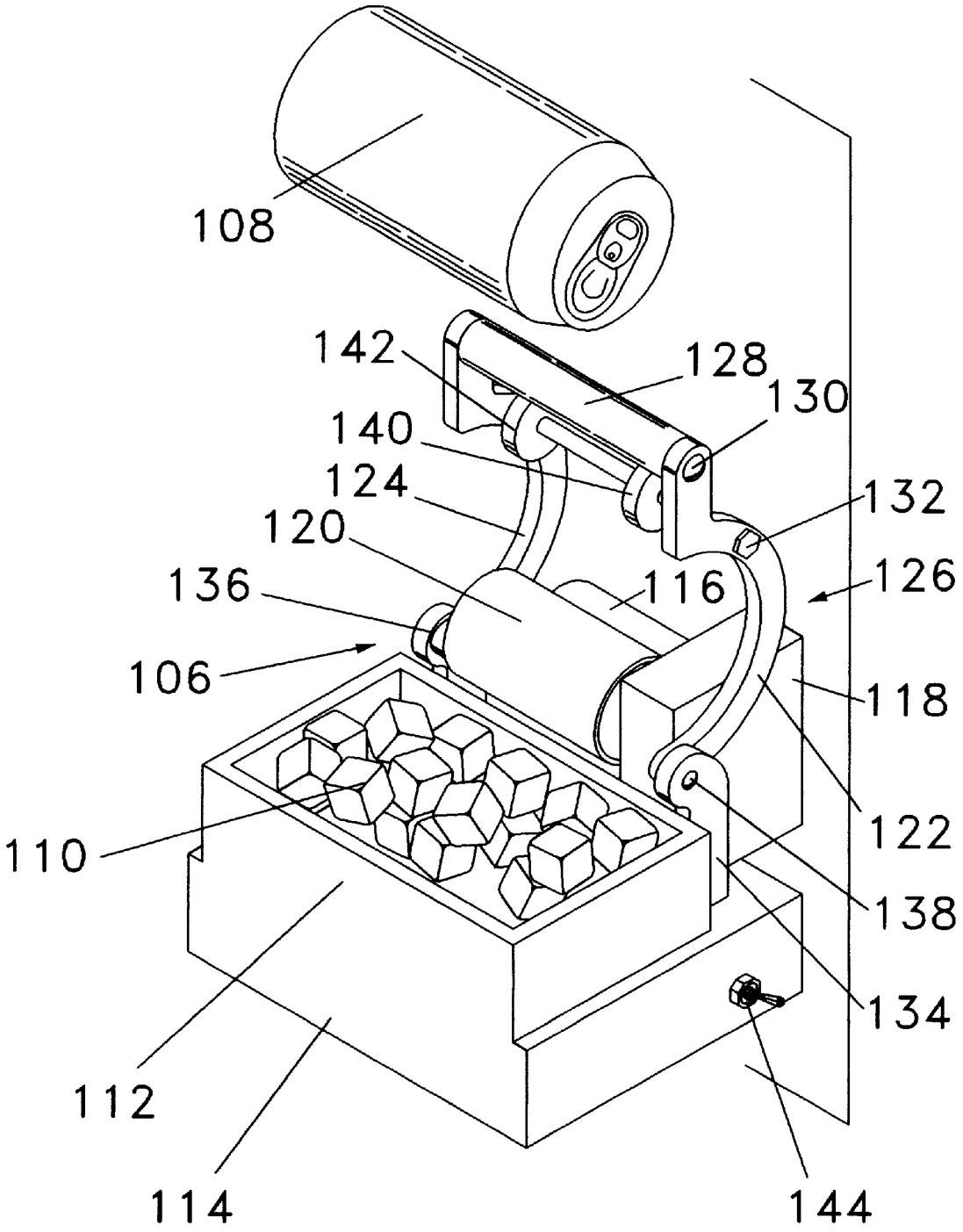
FIG. 5 is a front perspective view of a second embodiment of the present invention, showing a motor, gearbox, and drive roller, mounted on the back of a ice tray, with the framework in the raised position.

FIG. 5 reference numbers.

| | | | |
|---|---|---|---|
| 106 | quick cool appliance | 108 | beverage container |
| 110 | bed of ice | 112 | ice tray on 114 |
| 114 | base of 106 | 116 | motor |
| 118 | gearbox for 116 | 120 | drive roller |
| 122 | right frame member of 126 | 124 | left frame member of 126 |
| 126 | framework for 106 | 128 | first cross member of 126 |
| 130 | pair of bolts for 128 | 132 | second cross member of 126 |
| 134 | right upright support for 126 | 136 | left upright support for 126 |
| 138 | pair of hinge pins of 126 | 140 | right guide wheel |
| 142 | left guide wheel of 126 | 144 | on/off switch on 114 |

Figure 6:
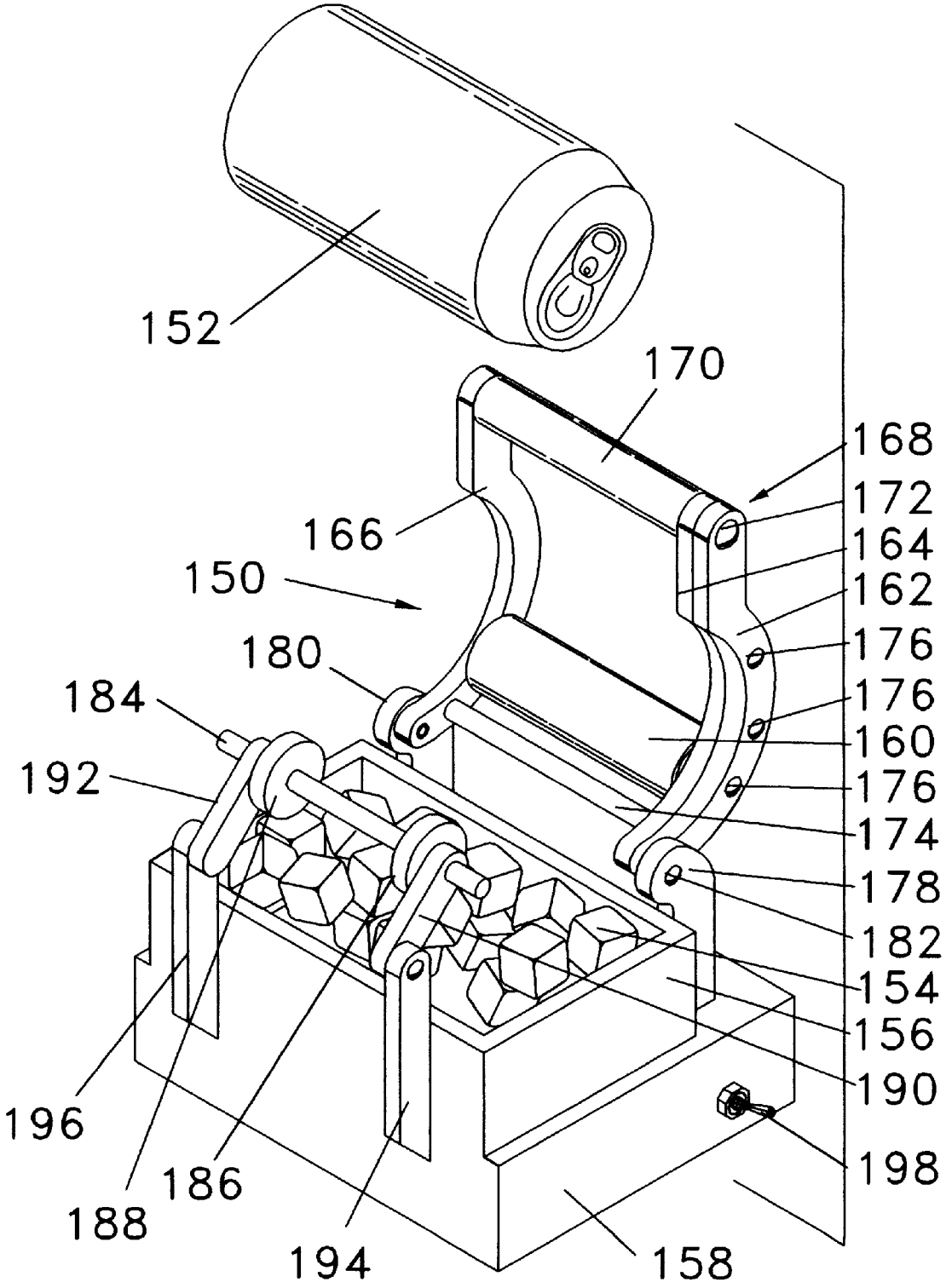
FIG. 6 is a front perspective view of a third embodiment of the present invention, showing a internally powered roller on the framework in the raised position, and a pair of guide rollers on a separate framework, hinged to supports on the front of the ice tray.

FIG. 6 reference numbers.

| | | | |
|---|---|---|---|
| 150 | quick cool appliance | 152 | beverage container |
| 154 | bed of ice in 156 | 156 | ice tray on 158 |
| 158 | base of 150 | 160 | drive roller for 150 |
| 162 | right frame member of 168 | 164 | middle frame member of 168 |
| 166 | left frame member of 168 | 168 | framework |
| 170 | first cross member of 168 | 172 | pair of bolts for 170 |
| 174 | second cross member of 168 | 176 | plurality of screws |
| 178 | right upright support | 180 | left upright support |
| 182 | hinge pins for 168 | 184 | axle for 186 and 188 |
| 186 | right guide wheel on 184 | 188 | left guide wheel on 184 |
| 190 | right swing arm for 184 | 192 | left swing arm for 184 |
| 194 | right upright support | 196 | left upright support |
| 198 | on/off switch on 158 | | |

Figure 7:
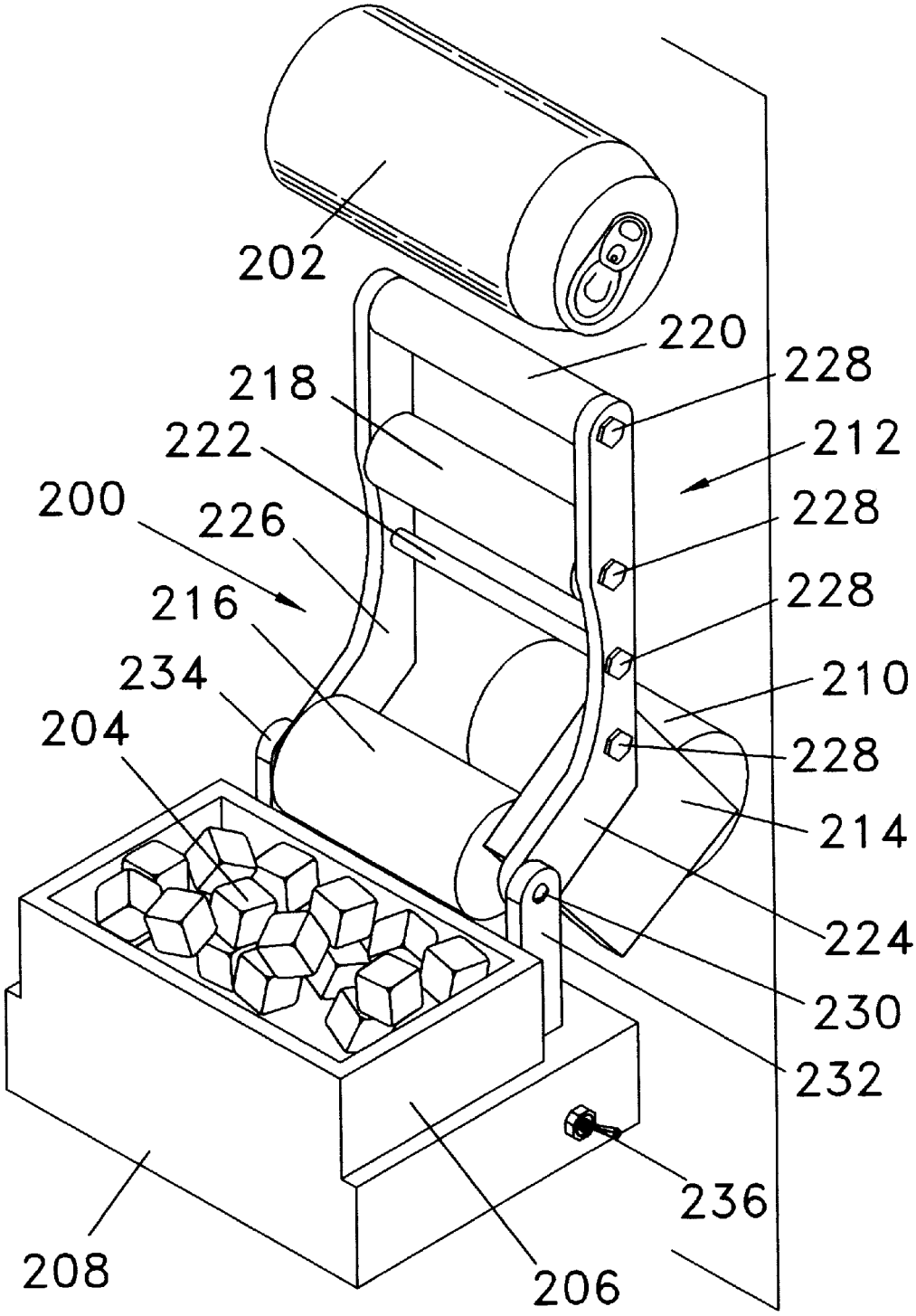
FIG. 7 is a front perspective view of a fourth embodiment of the present invention, showing a motor, gearbox and drive roller, mounted on the pivotal framework, with a guide roller mounted on the front of the framework.

FIG. 7 reference numbers.

| | | | |
|---|---|---|---|
| 200 | quick cool appliance | 202 | beverage container |
| 204 | bed of ice in 206 | 206 | ice tray of 200 |
| 208 | base of 200 | 210 | motor on 212 |
| 212 | framework of 200 | 214 | gearbox on 212 |
| 216 | drive roller on 212 | 218 | guide roller 212 |
| 220 | first cross member | 222 | second cross member |
| 224 | right frame member | 226 | left frame member |
| 228 | plurality of bolts | 230 | pair of hinge pins |
| 232 | right upright support | 234 | left upright support |
| 236 | on/off switch | | |

Figure 8:
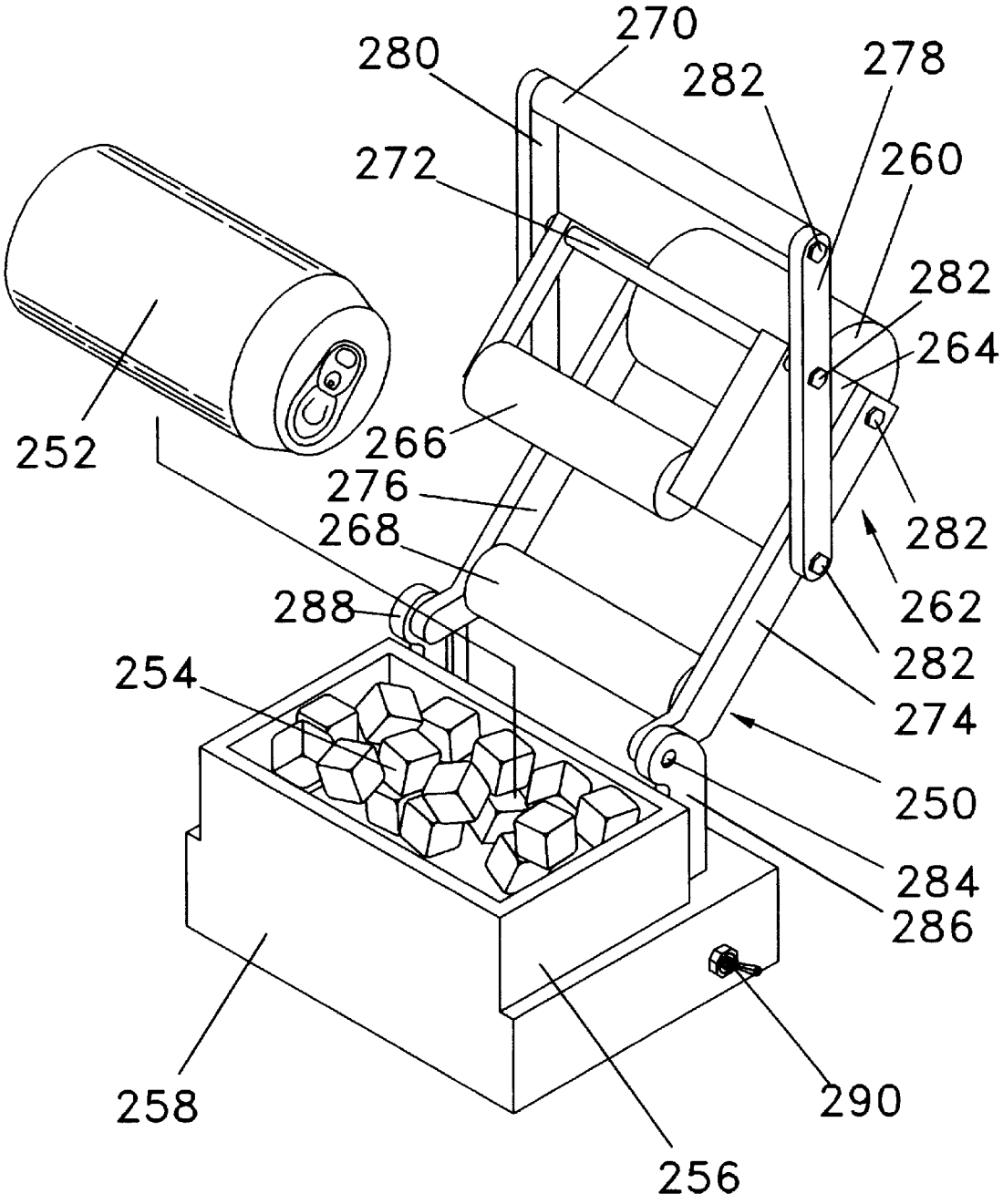
FIG. 8 is a front perspective view of a fifth embodiment of the present invention, showing a motor and gearbox mounted on a pivotal framework driving the front roller so as to impart rotary motion to a beverage container.

FIG. 8 reference numbers.

| | | | |
|---|---|---|---|
| 250 | quick cool appliance | 252 | beverage container |
| 252 | bed of ice in 256 | 256 | ice tray on 258 |
| 258 | base of 250 | 260 | motor on 262 |
| 262 | framework of 250 | 264 | gearbox on 260 |

-continued

REFERENCE NUMERALS IN DRAWINGS

| | | | |
|---|---|---|---|
| 266 | front drive roller | 268 | rear guide roller |
| 270 | first cross member | 272 | second cross member |
| 274 | right frame member | 276 | left frame member |
| 278 | right support arin | 280 | left frame member |
| 282 | plurality of bolts | 284 | pair of hinge pins |
| 286 | right upright support | 288 | left upright support |
| 290 | on/off switch on 256 | | |

Figure 9:
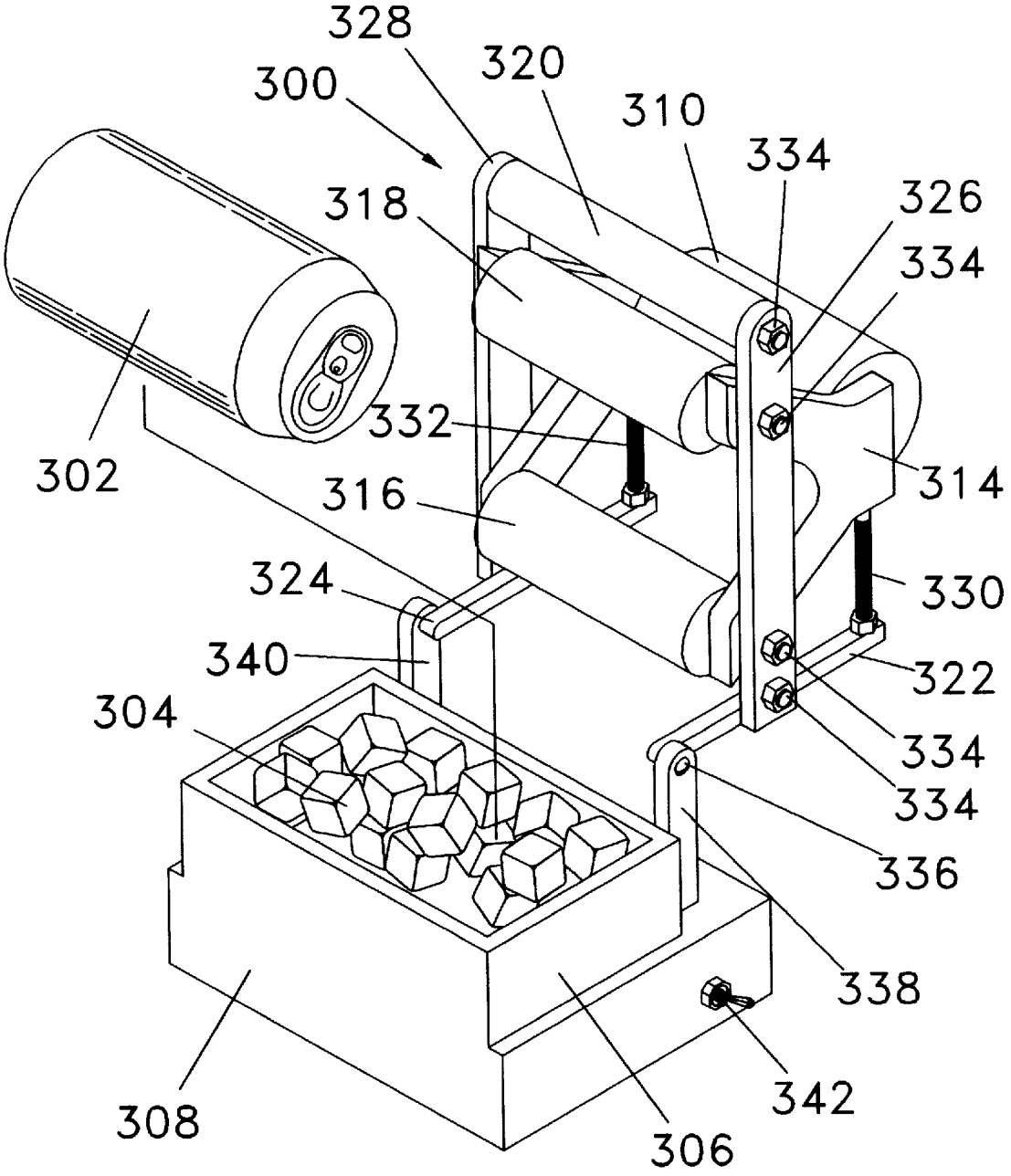
FIG. 9 is a front perspective view of a sixth embodiment, of the present invention, showing a split gearbox, motor, and two powered rollers, mounted on the pivotal framework, in the raised position.

FIG. 9 reference numbers.

| | | | |
|---|---|---|---|
| 300 | quick cool appliance | 302 | beverage container |
| 304 | bed of ice in 306 | 306 | ice tray on 308 |
| 308 | base of 300 | 310 | motor on 312 |
| 312 | framework | 314 | split gearbox on 312 |
| 316 | back drive roller | 318 | front drive roller |
| 320 | cross member | 322 | right swing arm |
| 324 | left swing arm | 326 | right gearbox support |
| 328 | left gearbox support | 330 | right support bolt |
| 332 | left support bolt | 334 | plurality of bolts |
| 336 | pair of hinge pins | 338 | right upright support |
| 340 | left upright support | 340 | on/off switch |

SUMMARY OF THE INVENTION

This invention pertains to the rapid chilling of canned or bottled beverages by rotating a beverage container on a bed of ice by means of a motor driven roller or rollers that contact and press downward on the beverage container according to the total weight of the framework and the equipment on the framework.

In accordance with the invention, a tray is provided to hold pieces of ice for the beverage container to rest on while being rotated by the rollers.

The motor or motors could be powered by alternating current or by a battery pack, and the battery pack could be rechargeable.

Both rollers could be powered by one motor and a gearbox that would split the power to the rollers, or the rollers could be powered by two separate motors, or one roller could be powered and the other roller would not be powered, but would have rotational motion imparted to it, by the rotation of the beverage container. The motor or motors could be installed inside of one or both of the rollers, on the framework that holds the rollers, or on the base of the appliance.

DETAILED DESCRIPTION OF THE PREFERRED EMBODIMENT

Referring to the drawings, FIGS. 1 through 4 illustrate a quick cool appliance 10, for a beverage container 12 resting on a bed of ice 14. An ice tray 16 is connected or molded to a base 18 that holds a battery pack 20 that provides electricity to power a pair of motor/gearbox units 22 and 24 that turn a pair of drive rollers 26 and 28 that impart rotary motion to the beverage container 12.

A framework 30 is held together by a first cross member 32 held in place by a pair of bolts 34 and 36, and a second cross member 38 held in place by a bolt 40 and a nut 42.

A set of framework members are shown as a right frame member 44, and a middle frame member 46, and a left frame member 48 are used to make up the framework 30 when held together by the first cross member 32, and the second cross member 38, along with bolts 34 and 36 and bolt 40 and nut 42 and a plurality of screws 50. A groove 52 is milled into the right frame member 44 to allow space for wires that provide electricity to the motor/gearbox units 22 and 24 held in place by a pair of motor mounts 54 and 56 secured to the framework 30.

The drive rollers 26 and 28 are secured by a press fit on a set of four wheels 58,60,62 and 64 placed on a set of four bearings 66, 68, 70 and 72 fastened to the framework 30 in alignment with the motor mounts 54 and 56.

Two of the wheels 62 and 64 are connected to a pair of drive shafts 74 and 76 extending outward from the motor/gearbox units 22 and 24 by a pair of drive pins 78 and 80 extending outward from the face of two wheels 62 and 64 engaging a socket 82 in a pair of connecting elements 84 and 86 that are held in place on the drive shafts 74 and 76 with a pair of set screws 88 and 90 in the connecting elements 84 and 86.

The battery pack 20 slides into the base 18 being held in place by a cover 92 secured by a plurality of screws 94.

The framework, 30 is allowed to swivel up or down on a set of hinge pins 96 and 98, near the top of a pair of upright supports, 100 and 102 extending upward from the base 18.

A on/off switch 104 located on the base 18 is used to turn the motor/gearbox units 22 and 24 on causing the drive rollers 26 and 28 to rotate, imparting rotational movement to the beverage container 12 while it is in contact with the bed of ice 14.

The on/off switch 104 is moved to the off position when it has been determined that the liquid in the beverage container 12 has been sufficiently cooled.

FIG. 5 illustrates a second embodiment of a quick cool appliance 106, for a beverage container 108 resting on a bed of ice 110. An ice tray 112 is connected to a base 114 that holds a battery pack to power a motor 116 connected to a gearbox 118 that turns a drive roller 120 that imparts rotary motion to the beverage container 108.

A set of framework members are shown as a right frame member 122, and a left frame member 124 and are used to make up a framework 126 when held together by a first cross member 128 held in place by a pair of bolts 130, and a second cross member 132.

The framework 126 is held in place on a pair of upright supports 134 and 136 by a pair of hinge pins 138 which allow the framework 126 to swivel to a upright resting position or downward to cause a pair of guide wheels 140 and 142 to force the beverage container 108 against the bed of ice 110 and against the drive roller 120 imparting rotational movement of the beverage container 108 when a on/off switch 144 is moved to the on position to provide electricity to the motor 116 creating a rapid flow of heat from the liquid in the beverage container 108 to the bed of ice 110.

FIG. 6 illustrates a third embodiment of a quick cool appliance 150, for a beverage container 152 resting on a bed of ice 154. An ice tray 156 is connected to a base 158 that holds a battery pack to power a motor inside a drive roller 160 that imparts rotary motion to the beverage container 152. A set of framework members are shown as a right frame member 162, a middle frame member 164, and a left frame member 166 and are used to make up a framework 168 when held together by a first cross member 170 held in place by a pair of bolts 172, and a second cross member 174 bolted between the middle frame member 164 and the left frame member 166 with a plurality of screws 176 holding the right frame member 162 to the middle frame member 164

The framework 168 is held in place on a pair of upright supports 178 and 180 by a pair of hinge pins 182 which allow the framework 168 to swivel to a upright resting position or downward to cause the framework to contact the ends of a axle 184 and force a set of guide wheels 186 and 188 downward against the beverage container 152.

The axle 184 is attached to a pair of swing arms 190 and 192 that pivot on two upright supports 194 and 196 fastened to the front of the ice tray 156 allowing the guide rollers 186 and 188 to swing forward so the beverage container 152 can be inserted or removed when the framework 168 is raised.

A on/off switch 198 is moved to the on position to provide electricity to the motor inside the drive roller 160 causing rotational movement of the beverage container 152 when the downward pressure of the framework causes the guide wheels 186 and 188 and the drive roller 160 to hold the beverage container 152 in alignment on the bed of ice 154 creating a rapid flow of heat from the liquid in the beverage container 152 to the bed of ice 154.

FIG. 7 illustrates a fourth embodiment of a quick cool appliance 200, for a beverage container 202 resting on a bed of ice 204. An ice tray 206 is connected to a base 208 that holds a battery pack to power a motor 210 mounted on the framework 212 that is connected to a gearbox 214 that provides rotary motion to a drive roller 216 that imparts rotary motion to the beverage container 202 that is held in alignment against the drive roller 216 by a guide roller 218.

The framework 212 is made up of a first cross member 220, a second cross member 222, a right frame member 224, and a left frame member 226 held together by a plurality of bolts 228 and a pair of hinge pins 230.

The hinge pins 230 connect the framework 212 to a right upright support 232, and a left upright support 234 attached to the base 208 and the back of the ice tray 206 allowing the framework 212 to pivot to an upright resting position so the beverage container 202 can be easily removed from or placed on the bed of ice 204 and also pivot downward to cause the guide roller 218 to press against the beverage container 202 forcing the beverage container 202 to contact the drive roller 216 causing rotation of the beverage container 202 when the drive roller 216 is rotating.

A on/off switch 236 is moved to the on position to provide electricity to the motor 210 causing rotational motion of the drive roller 216 imparting rotational motion to the beverage container 202 when the guide roller 218 and the drive roller 216 press downward so as to engage the beverage container 202 causing circulation of the liquid in the beverage container 202 to be rapidly cooled.

FIG. 8 illustrates a fifth embodiment of a quick cool appliance 250, for a beverage container 252 resting on a bed of ice 254. An ice tray 256 is connected to a base 258 that holds a battery pack to power a motor 260 mounted on the framework 262 that is connected to a gearbox 264 that provides rotary motion to a front drive roller 266 that imparts rotary motion to the beverage container 252 that is held in alignment against the front drive roller 266 by a rear guide roller 268.

The framework 262 is made up of a first cross member 270, a second cross member 272, a right frame member 274, and a left frame member 276, a right support arm 278, and a left support arm 280 held in place by a plurality of bolts 282 and a pair of hinge pins 284.

The hinge pins 284 connect the framework 262 to a pair of upright supports 286 and 288 mounted on the back of the ice tray 256 allowing the framework 262 to pivot to an upright resting position so the beverage container 252 can be easily removed from or placed on the bed of ice 254 and also pivot downward to cause the front drive roller 266 and the rear guide roller 268 to produce frictional engagement and impart rotary motion to the beverage container 252.

A on/off switch 290 is moved to the on position to provide electricity to the motor 260 causing rotational motion of the front drive roller 266 imparting rotary motion to the beverage container 252 when the front drive roller 266 and the rear guide roller 268 are allowed to move downward so as to engage the beverage container 252 causing liquid in the beverage container 252 to be rapidly cooled.

FIG. 9 illustrates a sixth embodiment of a quick cool appliance 300, for a beverage container 302 resting on a bed of ice 304. An ice tray 306 is connected to a base 308 that holds a battery pack to power a motor 310 mounted on the framework 312 that is connected to a split gearbox 314 that provides rotary motion to both drive rollers 316 and 318 that imparts rotary motion to the beverage container 302.

A cross member 320, a right swing arm 322, a left swing arm 324, a right gearbox support 326, a left gearbox support 328, a right support bolt 330, and a left support bolt 332 make up the framework 312 when held together by a plurality of bolts 334 and a pair of hinge pins 336.

The hinge pins 336 connect the framework 312 to a pair of upright supports 338 and 340 mounted on the back of the ice tray 306 allowing the framework 312 to pivot to an upright resting position, so the beverage container 302 can be easily removed from or placed on the bed of ice 304 and also pivot downward to cause the drive rollers 316 and 318 to produce frictional engagement and impart rotary motion to the beverage container 302.

An on/off switch 342 is moved to the on position to provide electricity to the motor 310 causing the drive rollers 316 and 318 to rotate and impart rotational movement to the beverage container 302 when the framework 312 and drive rollers 316 and 318 are lowered so as to engage the beverage container 302 causing liquid in the beverage container to circulate, creating a rapid flow of heat from the liquid in the beverage container 302 to the bed of ice 304.

CONCLUSION, RAMIFICATIONS, AND SCOPE

The design and construction result in a product that is simple and inexpensive to manufacture and could be made of various materials. The use of injected molded plastic could simplify the design by reducing the number of parts as illustrated herein.

While certain features of this invention have been shown and described, and are pointed out in the annexed claims, it is not intended to be limited to the details above, since it will be understood that the various omissions, modifications, substitutions and changes in the forms and details of the appliance illustrated, and it's operation can be made by those skilled in the art without departing in anyway from the spirit of the invention.

Various modifications and additions may be made and will be apparent to those skilled in the art.

Accordingly, the invention should not be limited by the forgoing description, but rather should be defined only by the following claims.

I claim:

1. An apparatus for cooling a beverage in a beverage container, comprising a. a bed of ice, in an ice tray, and a frame, b. a pair of rollers attached to said frame c. said rollers are arranged on said frame to be lowered on to said beverage container, and said rollers being further arranged to center said beverage container during rotation of said beverage container.

2. A method for cooling a beverage in a beverage container, comprising the steps of a. providing a frame, that is capable of upward or downward movement, b. attaching a pair of rollers to said frame which is configured to center said beverage container during rotation, c. placing said beverage container on a bed of ice, in an ice tray, d. lowering said frame down to make contact with said beverage container, and e. permitting said rollers to contact said beverage container when said frame is lowered, and said rollers will center said beverage container during rotation, f. causing rotational movement of said beverage container, whereby a circulating liquid in said beverage container will be quickly cooled, g. imparting rotational movement to said beverage container by means of an electric motor/gearbox turning said rollers, h. producing rapid cooling of said circulating liquid.

* * * * *

UNITED STATES PATENT AND TRADEMARK OFFICE

CERTIFICATE OF CORRECTION

PATENT NO. : 5,966,964

DATED : Oct. 19, 1999

INVENTOR(S) : Clark C. Pattee

It is certified that error appears in the above-identified patent and that said Letters Patent is hereby corrected as shown below:

On column. 2, line 6 insert, (-- U.S. Pat. No. 4,078,397 issuing Mar. 14, 1978 to Brande for BEVERAGE CONTAINER COOLING DEVICE discloses a device for cooling canned beverage. The device is large, cumbersome and burdensome if the device has to be moved to another location. It is also difficult to use because the device has to be placed in a location and at a height that will allow the cranking of the roller means and the large, chest like ice compartment has to have a large amount of ice placed in it before using by placing a container of beverage on the ice and then a large upper housing unit containing a large roller means made up of a roller, a shaft, a crank, two legs and a handle has to be attached to the lower housing unit with a buckle style latch in the front of the device and another latch on the back.

UNITED STATES PATENT AND TRADEMARK OFFICE

CERTIFICATE OF CORRECTION

PATENT NO. : 5,966,964

DATED : Oct. 19, 1999

INVENTOR(S) : Clark C. Pattee

It is certified that error appears in the above-identified patent and that said Letters Patent is hereby corrected as shown below:

Then the operator has to use one hand to hold the handle of the roller means downward to maintain pressure of the roller against the beverage container while the operator cranks the crank with the other hand for three or four minutes. Then the upper housing unit has to be unattached and removed and set aside before the beverage container can be removed from the lower housing unit.--)

Signed and Sealed this

Eighth Day of August, 2000

*Attest:*

*Attesting Officer*

Q. TODD DICKINSON

*Director of Patents and Trademarks*